United States Patent [19]

Ennis

[11] 4,282,088

[45] Aug. 4, 1981

[54] PROCESS FOR CLEANING FINE COAL

[75] Inventor: Robert E. Ennis, West Simsbury, Conn.

[73] Assignee: Linatex Corporation of America, Stafford Springs, Conn.

[21] Appl. No.: 126,287

[22] Filed: Mar. 3, 1980

[51] Int. Cl.[3] ..... B03B 7/00; B03B 5/66

[52] U.S. Cl. ..... 209/17; 209/172.5; 209/454; 209/496

[58] Field of Search ..... 209/17, 172.5, 158–161, 209/454, 208

[56] References Cited

U.S. PATENT DOCUMENTS

| | | | |
|---|---|---|---|
| 1,895,505 | 1/1933 | Wuensch | 209/172.5 |
| 2,417,660 | 3/1947 | Remick | 209/158 X |
| 2,497,790 | 2/1950 | Pauvrasseau | 209/172.5 |
| 4,028,228 | 6/1977 | Ferris et al. | 209/172.5 X |

FOREIGN PATENT DOCUMENTS

| | | | |
|---|---|---|---|
| 1303067 | 1/1973 | United Kingdom | 209/158 |

*Primary Examiner*—Ralph J. Hill

*Attorney, Agent, or Firm*—Prutzman, Kalb, Chilton & Alix

[57] ABSTRACT

A process for the wet concentration and cleaning of fine coal is provided which comprises the steps of desliming and thickening a dilute slurry of fine coal and contaminant particles having a size of less than about 10 mm by introducing the same to a hydrocyclone separator to retain a slurry of particles having a size greater than about 0.1 mm, wet concentrating the last-named slurry and removing the heavier contaminant particles by introducing it to an autogenous dense medium separation vessel having a manifold for injecting water at an intermediate level and controlling the underflow of heavier than coal particles to maintain a fluidized bed of heavier particles and causing a slurry of the lighter coal particles to overflow, and concentrating and dewatering the overflow by means of a static or vibratory sizing screen.

10 Claims, 2 Drawing Figures

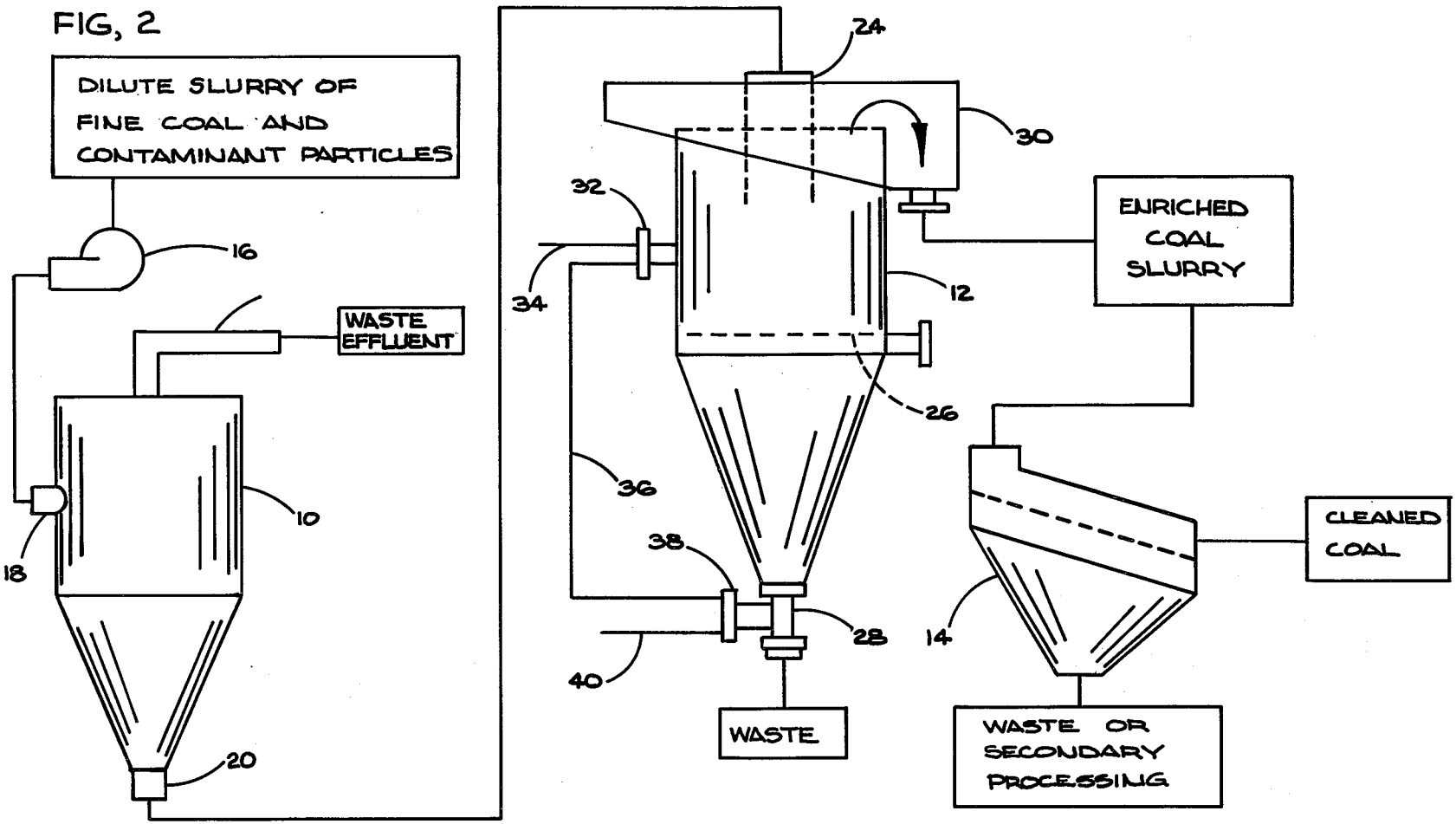
FIG, 2

PROCESS FOR CLEANING FINE COAL

BACKGROUND AND SUMMARY OF THE INVENTION

The present invention relates to a process for separating and cleaning coal of fine particle size and, more particularly, is concerned with a new and improved wet process for removing unwanted contaminant particles from fine coal utilizing mechanical and hydraulic means.

The invention has particularly application to the treatment of contaminated coal having a particle size of less than about 10 mm. Coal particles of small size are difficult and expensive to separate from the usual associated contaminant particles such as rock, pyrite, slime, clay, silt and the like. Moreover, with the increasing use of continuous mechanical coal mining apparatus, the generation of such finely sized coal by such extraction techniques has become a significant factor usually representing 30 to 40 percent of normal "run of mine" output.

One source of contaminated coal of such small particle size is in mining operations wherein the mined coal containing the usual rock and other contaminating impurities is separated into fractions by passing the crushed "run of mine" coal across a sizing screen deck while subjected to water sprays which assist in the separation. The subsequent cleaning of the large or coarse fraction containing particles having a size range above about 10 mm presents no problem as this can be readily accomplished using conventional mechanical cleaning methods or heavy media bath or drum separation techniques by means of which the coal particles are floated off while the contaminant material sinks and is removed as waste material. The fine fraction, however, is not susceptible to cleaning by this method, and requires a different treatment to permit the coal to be separated from its associated contaminants. Another potentially important source of contaminated coal of small particle size may be found in waste or refuse deposits produced during earlier mining operations when the fine material generally minus 6 mm or minus 0.6 mm in size, was regarded merely as waste material to be disposed of because there was at the time, little market demand and further treatment for recovery of the coal content was regarded as not economically feasible.

Various chemical and mechanical processes have been employed heretofore for cleaning contaminated coal particles of fine size. One of the better processes that has been commercially used is described and claimed in my prior U.S. Pat. No. 4,128,474 assigned to the assignee of the present invention and comprises passing a slurry of the fine particles through spiral gravity concentrators and separators to separate and remove the heavy contaminants following which the remaining fine coal slurry is delivered to a hydrocyclone separator to remove the very fine or ultra-fine contaminants. Other processes have included chemical flotation, shaking tables, heavy media cyclones, water only cyclones and air separation. Among these techniques, the most commonly used system has been the use of shaking table separators. The vibratory motion of the shaking tables has the disadvantages of poor efficiency below 48 mesh and high energy consumption. The shaking tables also require large plant floor space per ton processed and have a relatively high initial cost.

Another separating system widely used heretofore has been the use of heavy media cyclones. This process is described in detail in chapter 10 of the publication *Coal Preparation* published in 1968 by the American Institute of Mining, Metallurgical and Petroleum Engineers, Inc., New York, N.Y. In this process, finely sized coal is separated from its associated impurities by suspending the mixture of coal and the associated heavier than coal particles in a liquid medium composed of water and magnetite (iron particles) and then pumping this suspension to a hydrocyclone under pressure. The water/magnetite ratio is controlled so that the liquid medium exhibits an apparent specific gravity only slightly heavier than the coal being treated, thereby causing the coal particles to rise and overflow the cyclone while the heavier contaminants such as rock and pyrite sink within the cyclone and report as the cyclone underflow or refuse product.

While the use of heavy medium cyclones is a proven, highly efficient method for separating finely sized coal from heavier particles, it is not effective for treating materials having a size finer than about 28 mesh because the smaller impurity particles possess insufficient mass to sink within the dense liquid medium. Another disadvantage is the high cost of magnetite lost during processing because it cannot be effectively washed from the finely sized coal and refuse particles. This loss can amount to about 5 lbs. per ton of clean coal produced which in the operation of an average plant could result in an annual cost of as much as $100,000 for magnetite consumed based on current prices. Further disadvantages are high energy requirements and a relatively heavy investment in associated equipment such as draining and washing equipment for recovering and recycling the magnetite used in the process. Therefore, because of the desire to increase the availability and production of coal as an alternative economic source of energy to meet present energy requirements, the industry has been seeking to develop improved processes which are equally efficient and less expensive to install and operate for separating and cleaning coal particles of small size which typically account for about $\frac{1}{4}$ to $\frac{1}{3}$ of the total output of a modern mine that uses continuous mining machines.

Accordingly, it is a principal object of the present invention to provide a new process for separating and cleaning coal of fine particle size which is equally efficient in operation when compared to heretofore known methods and more economical to install and operate and which utilizes commercially available equipment.

A more specific object is to provide such an improved dense media separation process which does not require the use of expensive additive heavy media such as magnetite and which is characterized by a reduced energy consumption and does not require expensive ancillary equipment for magnetite media recovery.

Another object is to provide an improved process of the type referred to which is more versatile from the standpoint of being applicable for the processing of coal particles of fine size having a wide range of contaminant including particularly those with a very high refuse content and being controllable and easily variable for effecting a variety of separations.

Other objects will be in part obvious, and in part pointed out more in detail hereinafter.

These and related objects are accomplished in accordance with the present invention by providing an autogenous process for cleaning fine coal that utilizes a three, interdependent step technique for sequentially and selectively removing impurity fractions. In the first cleaning step, an aqueous slurry of the particles having a size of less than about 10 mm is fed to a hydrocyclone to remove the undesirable clay and silt particles smaller than about 0.1 mm together with most of the slime water present in the feed. In the second step, the hydrocyclone underflow containing the substantially deslimed particles of a size larger than about 0.1 mm is introduced to a dense medium separation vessel in which a dense fluidized bed of heavier than coal contaminant particles such as rock, shale and sandstone is maintained in such controlled fashion that coal particles entering the vessel are unable to penetrate the bed and instead, assisted by water which is injected into the vessel so as to cause a slight upward current flow, rises and overflows the vessel substantially free of the heavier contaminant particles originally present in the feed. In the third step, the water borne, coal rich overflow product recovered as just described and normally containing very fine contaminant material, typically less than about 0.250 mm in size, is fed to a static or vibrating screen in which the wire mesh or screen permits the water and very fine contaminants to pass through while the enriched dewatered coal product passes over the top of the deck to a collector as the desired finished coal end product.

BRIEF DESCRIPTION OF THE DRAWING

In the Drawing:

FIG. 2 is a flow chart schematically depicting a preferred embodiment of the process of the invention.

DESCRIPTION OF THE PREFERRED EMBODIMENT

Figure 1:
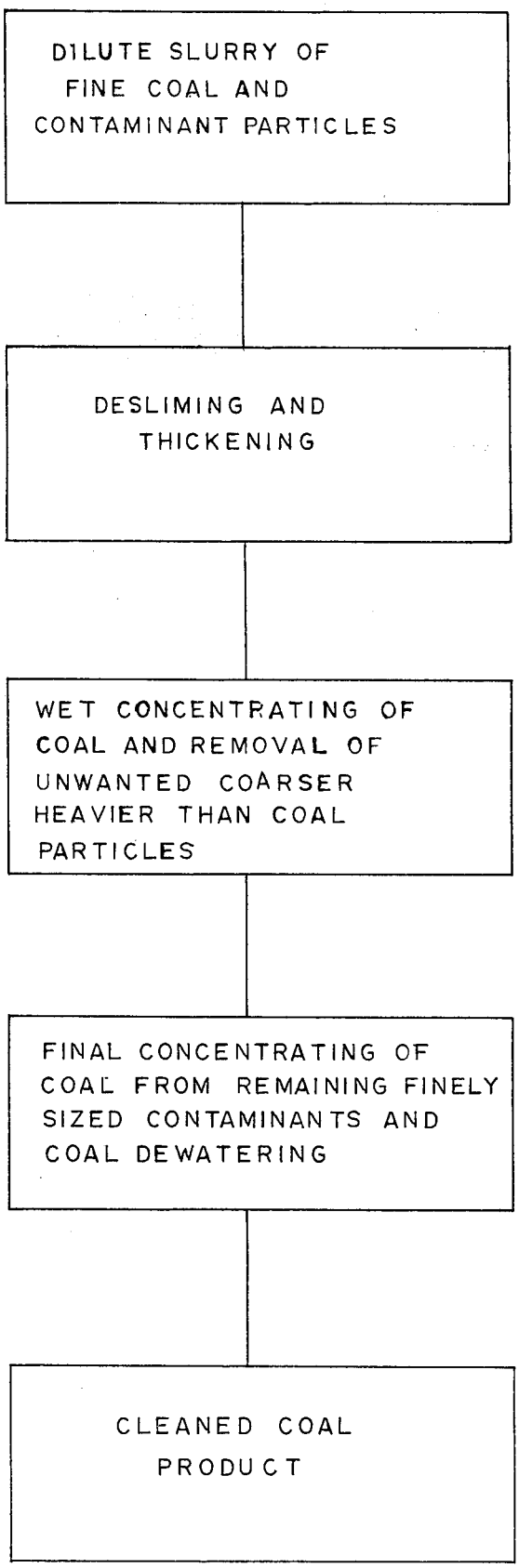
FIG. 1 is a block diagram of the process of the present invention.

Referring to the drawing, the three step operation of the process of the invention as set forth in the block diagram of FIG. 1 is illustrated schematically in FIG. 2 as comprising a primary desliming and thickening operation carried out by means of a hydrocyclone 10, a wet concentrating operation carried out by the use of a dense medium separation vessel 12, and a final concentrating and dewatering operation effected by means of a static or vibrating screen 14.

As previously mentioned, the process of the present invention has particular utility for the treatment of contaminated coal wherein the particle size is less than about 10 mm and preferably less than about 6 mm. If the source of coal to be treated contains an appreciable amount of particles of larger size than that, it is necessary to first remove these larger particles for subsequent treatment in a different manner. Separation of the larger particles can easily be effected by the action of a water spray as the material flows across a vibratory sizing screen as described in the publication *Coal Preparation, supra.* The fine coal slurry resulting from the sizing screen operation or a slurry of fine particles derived from any other source of predominatly fine coal particles and the usual associated contaminants such as, for example, rock, slime, clay, silt and pyrite sulfur, is the starting material to be processed in accordance with the invention.

The fine coal slurry may vary substantially in solids content but, in general, the solids content should be less than 35 percent by weight and preferably between 20 and 30 percent for optimum efficiency of processing. As previously mentioned, this slurry in the first step of its process is subjected to a primary thickening operation and also desliming by being introduced under pressure such as by means of the pump 16 to the tangential inlet 18 of the hydrocyclone 10. In the hydrocyclone 10 the feed slurry is subjected to centrifugal forces causing the larger particles to be concentrated and discharged from the underflow or lower apex 20 while the finer particles such as unwanted clay and silt together with most of the water upwardly and is discharged through the interior vortex finder 22. The effective opening of the aforementioned vortex finder, the lower apex 20 cyclone diameter and feed pressure are adjusted in known manner to control the underflow therethrough at a rate which will cause particles having a size greater than about 0.1 mm to exit through the lower apex 20 while particles smaller than that and ultra-fine silt material are retained in suspension and are discharged through vortex finder 22 for disposal or treatment as waste effluent.

The thickened and deslimed mixture of coal and contaminant particles underflowing the hydrocyclone 10 is then subjected to the second step of wet concentrating by introducing it to the feed tube 24 of the dense medium separation vessel 12. Also introduced into the vessel 12 is an upward flow of water created by injection of water from any convenient source (not shown) through the manifold 26. A discharge valve 28 is provided at the lower conical end of the vessel 12 to control the rate of discharge of the heavier contaminants therethrough. In the operation of the separation step, the aim is to create a fluidized bed of closely crowded heavier than coal contaminant particles extending upwardly from the bottom portion of vessel 12 such that coal particles entering through the feed tube 24 will be unable to penetrate the bed and instead will be carried upwardly in the rising current of water emanating from the manifold 26 to be discharged through the overflow weir 30. The contaminants comprising particles of rock, shale, sandstone, pyrite and the like usually exhibit a specific gravity greater than 1.5 while the coal particles generally have a specific gravity of 1.5 or less.

The control and maintenance of the desired fluidized "dense media" bed of heavier than coal particles is accomplished in accordance with the invention by mounting a density sensor/transmitter 32 in the upper section of the vessel 12 below the overflow weir 30 and operatively connecting it to means for controlling the valve 28 whereby the underflow from vessel 12 is regulated so as to maintain the height of the fluidized dense media bed of heavier particles at slightly above the location of the sensor/transmitter 32. The sensor/transmitter 32 may be of any suitable commercially available type such as the pneumatic balance pressure responsive transmitter denoted as Series 13F manufactured and sold by The Foxboro Company of Foxboro, Mass. This instrument is mounted on the side of vessel 12 in communication with the interior and has a diaphragm (not shown) subjected to the pressure within the tank. The operation of the transmitter is such that when connected to a source of air under pressure as represented by the pipe 34 it will transmit a pneumatic signal via the pipe 36 to the controller 38 for the valve 28 which signal is proportional to the dense media level in vessel 12. The controller 38 is a device which will adjust the opening of the associated valve 28 in relationship to the pneumatic signal received from the transmitter 32 so that when the level of the fluidized dense media bed of heavier particles starts to drop, the valve will be operated in a closing direction to restore the height of the bed and when the level starts to rise the valve is operated in an opening direction thus producing a teeter condition maintaining the level or specific gravity of the fluidized bed at a value which will result in floating off of the desired quality of coal. Any commerically available controller which will function in this manner may be used such as the Type C Vernier Valvactor also manufactured and sold by The Foxboro Company previously mentioned. When such a device is installed as the controller 38, it is connected to a source of air under pressure represented by pipe 40 and utilizes this as the operating force for adjusting the valve 28 in an opening or closing direction responsive to the pneumatic signals received from the transmitter 32 via the pipe 36.

As previously mentioned, the result of the processing of the slurry of particles in the dense medium separation vessel 12 is that the heavier more dense contaminants are removed as a coal free underflow product via the discharge valve 28 while a coal rich slurry overflows the top of the vessel for discharge via the overflow weir 30. The underflow product is all waste material and may be disposed of in any desired manner. Because of its water content, and to facilitate subsequent handling, usually by conveyor, the underflow product is preferably dewatered prior to disposal such as by use of a dewatering system as described and claimed in prior U.S. Pat. No. 3,970,549 assigned to the assignee of the present invention. The coal rich slurry emanating from the overflow weir 30 will contain coal ranging in size from 10 mm (or 6 mm) to zero and some very finely sized or ultra-fine rock, silt, clay and the like, having a particle size of less than about 0.250 mm (smaller than the associated coal). Accordingly, this slurry is next subjected to the third step of the process of my invention which is a final concentrating and dewatering operation utilizing a static or vibrating screen. In the schematic flow chart shown in the drawing, the screen 14 is preferably of the type having a finely sized wire mesh decking together with deck panels as described in prior U.S. Pat. No. 3,970,549 and also preferably provided with a vacuum assist water removal as described and claimed in prior U.S. Pat. No. 3,929,642, both patents being assigned to the assignee of the present invention.

During the operation of the vibrating screen, the inclined screen is oscillated causing the water and some fines having a size of the order of 0.25 mm or less to pass through the screen while the fine coal fraction flows along the top of the screen and is discharged from the end thereof as the desired dewatered and cleaned coal. The water and fines mixture passing through the screen may be discarded as waste if desired, but in many instances, the coat content of the fines will be sufficient to permit them to be separated and cleaned economically utilizing the process described and claimed in the prior U.S. Pat. No. 4,128,474 previously referred to, or by other means.

As a result of the cleaning and dewatering process of the invention the resulting fine coal fraction shows substantial benefication with an appreciable reduction in both ash and sulfur content. Exemplary of the reduction in ash and sulfur resulting from this process are the data set forth in the following table:

TABLE NO. 1

| Pilot Test Run | Process Feed % Ash | Process Refuse % Ash | Process Fine Coal Product % Ash |
|---|---|---|---|
| A* | 42% | 84.1% | 13.0% |
| B | 23% | 76.7% | 8.0% |
| C* | 65.2% | 76.9% | 14.6% |

*Tests performed on anthracite mine waste laid down from previous processing operations. Test runs performed with a continuous feed slurry for durations of 3–4 hours each. Product samples taken at 30 minute intervals and composited to obtain average analysis of % ash.

In each case, the process feed had a particle size of less than ¼ inch (6 mm) and was fed to the desliming cyclone (step 1) at a rate of about 3 tons per hour in a water slurry containing a solids concentration of about 20% by weight. The hydrocyclone had a feed box diameter of about 10 inches, and was fitted with an underflow regulator. Cyclone underflow contained essentially all of the material present in the cyclone feed larger than about 0.1 mm, in a concentration of about 60% solids by weight. The dense medium separator vessel (step 2) had a feed chamber of approximately 20 inches diameter, and was fitted with a density sensor/-transmitter of the pneumatic force-balance type such as the type "Series 13F" as manufactured by The Foxboro Company, Foxboro, Mass., U.S.A.

Injection water was supplied to the dense medium vessel at pressures varying between 8 psig and 15 psig. The vessel discharge valve was 2 inches in diameter and of the pneumatic pinch valve type. The underflow "refuse" product discharging from the dense media separator had a density of about 75% solids by weight. The coal rich overflow discharging over the overflow weir of the dense medium vessel was screened on static screens with a 30 mesh square opening in the case of pilot tests A and B, and a 48 mesh square opening in the case of test C.

It will be noted that the ash content in the finished coal product is typically reduced to about 20% to 30% of its original level. It will be appreciated that the characteristic presence of inherent ash in all coal material makes the complete removal of these contaminants impossible. In all instances, a substantial beneficiation is evident from the ash analyses of the clean coal product relative to its corresponding feed material, and in each pilot test a commercially acceptable coal product was produced.

As will be apparent to persons skilled in the art various modifications, adaptations and variations of the foregoing specific disclosure can be made without departing from the teachings of the invention.

I claim:

1. A process for the wet concentration and cleaning of fine coal comprising the steps of introducing a feed slurry of coal and associated contaminant particles having an average particle size predominantly less than about 6 mm to a hydrocyclone separator having an ascending vortex finder and an underflow discharge port, regulating the discharge from the discharge port to provide controlled discharge at said port of a coal particle fraction having a particle size greater than about 0.1 mm while discarding substantially all the fine silt of less than 0.1 mm reporting to the ascending vortex finder, introducing the controlled discharge of greater particle size to the upper end of a dense medium separation vessel having a manifold for injecting water at an intermediate level and having a variable orifice at its lower end for releasing the heavier particles therefrom, controlling the effective size of the orifice at the lower end for maintaining a fluidized bed of heavier than coal contaminant particles extending upwardly from the lower end of the vessel whereby heavier contaminant particles in the feed slurry may enter and pass downward for removal while the portion of the feed slurry containing only the lighter particles of coal and very small heavier contaminant will be suspended above said fluidized bed for selective recovery and introducing the latter slurry to a concentrating and dewatering screen to release water and particles having a size of the order of 0.25 mm or less and thereby recovering the cleaned and dewatered coal fraction of the feed slurry.

2. The process of claim 1 wherein the fleed slurry of coal and associated contaminant particles has a solids content not exceeding about 35% by weight.

3. The process of claim 1 wherein an upward rising current of water is produced in the dense medium separation vessel which causes a slurry of the lighter coal particles and very finely sized contaminants to rise and overflow from the top of the vessel.

4. The process of claim 1 wherein heavier than coal particles are released from the lower end of the dense medium separation vessel at a rate effective for maintaining the fluidized bed of heavier than coal particles at a teetering level below the top of the vessel.

5. The process of claim 1 wherein the effective size of the orifice at the lower end of the dense medium separation vessel is controlled responsive to the specific gravity of the fluidized bed within the vessel whereby the effective size of the orifice is increased responsive to an increase in said specific gravity and decreased responsive to a decrease in the specific gravity thereby maintaining the fluidized bed of heavier than coal particles at a desired teetering level.

6. The process of claim 5 which includes continuously monitoring the specific gravity of the contents of the dense medium separation vessel at the upper end of the vessel, and transmitting a controlling signal responsive to said specific gravity for varying the effective size of the orifice at the lower end of the vessel.

7. The process of claim 6 wherein air pressure is utilized for transmitting the controlling signal and varying the effective size of the orifice.

8. The process of claim 6 wherein the specific gravity of the contents of the dense medium separation vessel is monitored by the use of pressure sensitive means placed in communication with the interior of the vessel at its upper end.

9. The process of claim 5 wherein the effective size of the orifice at the lower end of the dense medium separation vessel is adjusted by opening and closing a valve located in the lower end of the vessel.

10. The process of claim 9 wherein the valve is adjusted by applying air pressure thereto responsive to variations in specific gravity of the contents of the dense medium separation vessel at the upper end thereof.

* * * * *